US006422681B1

(12) United States Patent
Berg et al.

(10) Patent No.: US 6,422,681 B1
(45) Date of Patent: Jul. 23, 2002

(54) CAP GIMBALING MECHANISM

(75) Inventors: Richard H. Berg; Arthur J. Sobon, both of Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/594,691

(22) Filed: Jun. 16, 2000

(51) Int. Cl.[7] ..... B41J 2/165
(52) U.S. Cl. ..... 347/32
(58) Field of Search ..... 347/29, 32; 248/178.1, 248/183.3

(56) References Cited

U.S. PATENT DOCUMENTS

| | | | | |
|---|---|---|---|---|
| 4,746,938 A | | 5/1988 | Yamamori et al. | 347/28 |
| 4,853,717 A | | 8/1989 | Harmon et al. | 347/29 |
| 4,855,764 A | | 8/1989 | Humbs et al. | 347/31 |
| 5,151,715 A | | 9/1992 | Ward et al. | 347/33 |
| 5,250,962 A | | 10/1993 | Fisher et al. | 347/32 |
| 5,252,993 A | * | 10/1993 | Tomii et al. | 347/32 |
| 5,339,102 A | | 8/1994 | Carlotta | 347/32 |
| 5,500,659 A | | 3/1996 | Curran, Jr. et al. | 347/28 |
| 5,548,310 A | | 8/1996 | Binnert et al. | 347/33 |
| 5,659,341 A | | 8/1997 | Kinas | 347/33 |
| 5,712,668 A | * | 1/1998 | Osbourne et al. | 347/32 |
| 5,936,647 A | * | 8/1999 | Rhodes et al. | 347/29 |
| 5,943,071 A | | 8/1999 | Premnath | 347/33 |
| 6,130,684 A | | 10/2000 | Premnath et al. | 347/30 |
| 6,135,585 A | * | 10/2000 | Johnson et al. | 347/32 |

* cited by examiner

*Primary Examiner*—John Barlow
*Assistant Examiner*—Blaise Mouttet
(74) *Attorney, Agent, or Firm*—Oliff & Berridge, PLC

(57) ABSTRACT

A method and system for a cap gimbal for a maintenance station of an ink jet printer with a first and second printhead each with a nozzle face that ejects ink. The cap gimbaling system allows a movable base which supports the maintenance caps to move in unison with the printheads and effectively seal the nozzle face.

8 Claims, 8 Drawing Sheets

CAP GIMBALING MECHANISM

BACKGROUND OF THE INVENTION

1. Field of Invention

This invention relates to maintenance stations for ink jet printing apparatus.

2. Description of Related Art

Ink jet printers have at least one printhead that directs droplets of ink towards a recording medium. Within the printhead, the ink may be contained in a plurality of channels. Energy pulses are used to expel the droplets of ink, as required, from orifices at the ends of the channels.

In a thermal ink jet printer, the energy pulses are usually produced by resistors. Each resistor is located in a respective one of the channels, and is individually addressable by current pulses to heat and vaporize ink in the channels. As a vapor bubble grows in any one of the channels, ink bulges from the channel orifice until the current pulse has ceased and the bubble begins to collapse. At that stage, the ink within the channel retracts and separates from the bulging ink to form a droplet moving in a direction away from the channel and towards the recording medium. The channel is then re-filled by capillary action, which in turn draws ink from a supply container. Operation of a thermal ink jet printer is described in, for example, U.S. Pat. No. 4,849,774.

A carriage-type thermal ink jet printer is described in U.S. Pat. No. 4,638,337. That printer has a plurality of printheads, each with its own ink tank cartridge, mounted on a reciprocating carriage. The channel orifices in each printhead are aligned perpendicular to the line of movement of the carriage. A swath of information is printed on the stationary recording medium as the carriage is moved in one direction. The recording medium is then stepped, perpendicular to the line of carriage movement, by a distance equal to the width of the printed swath. The carriage is then moved in the reverse direction to print another swath of information.

The ink ejecting orifices of an ink jet printer need to be maintained, for example, by periodically cleaning the orifices when the printer is in use, and/or by capping the printhead when the printer is out of use or is idle for extended periods. Capping the printhead is intended to prevent the ink in the printhead from drying out. The cap provides a controlled environment to prevent ink exposed in the nozzles from drying out.

A printhead may also need to be primed before initial use, to ensure that the printhead channels are completely filled with the ink and contain no contaminants or air bubbles. After significant amounts of printing, and at the discretion of the user, an additional but reduced volume prime may be needed to clear particles or air bubbles which cause visual print defects. Maintenance and/or priming stations for the printheads of various types of ink jet printers are described in, for example, U.S. Pat. Nos. 4,364,065; 4,855,764; 4,853,717 and 4,746,938, while the removal of gas from the ink reservoir of a printhead during printing is described in U.S. Pat. No. 4,679,059.

The priming operation, which usually involves either forcing or drawing ink through the printhead, can leave drops of ink on the face of the printhead. As a result, ink residue builds up on the printhead face. This ink residue can have a deleterious effect on the print quality. Paper fibers and other foreign material can also collect on the printhead face while printing is in progress. Like the ink residue, this foreign material can also have deleterious effects on print quality.

The 717 patent discloses moving a printhead across a wiper blade at the end of a printing operation so that dust and other contaminants are scraped off the orifice before the printhead is capped, and capping the printhead nozzle by moving the printer carriage acting on a sled carrying the printhead cap. This eliminates the need for a separate actuating device for the cap. The 938 patent discloses providing an ink jet printer with a washing unit which, at the end of the printing operation, directs water at the face of the printhead to clean the printhead before it is capped.

SUMMARY OF THE INVENTION

This invention provides a cap gimbaling system usable for a maintenance station for an ink jet printhead, that carries and supports one or more printhead caps movably mounted on a cap carriage to cap the printhead nozzles.

In one exemplary embodiment of the maintenance station according to this invention, one or more printheads are mounted on a translatable carriage and moves with the carriage. When the printer is printing, the translatable carriage is located in a printing zone, where the one or more printheads can eject ink onto a recording medium. When the printer is placed into a non-printing mode, the translatable carriage is translated to the maintenance station located outside and to one side of the printing zone. Once the cartridge is translated to the maintenance station, various maintenance functions can be performed on the one or more printheads depending on the rotational position of the cam shaft. The cam shaft engages and drives the hardware that in turn operates the individual maintenance functions.

Rotating the cam shaft activates various maintenance mechanisms of the maintenance station, including a wiper blade platform and a cap carriage. The wiper platform passes across the printhead nozzle faces when the one or more printheads enter the maintenance station and again just before the one or more printheads leave. A location for collecting ink cleared from the nozzles is placed adjacent to the wiper blades. After the one or more printheads arrive at the maintenance station, a vacuum pump is energized, and the cap carriage is elevated to the position where the one or more printhead caps engage the one or more printheads. The one or more printhead caps are mounted on the cap carriage in a capping location. The printheads are primed when a pinch tube mechanism opens one or more pinch tubes connected to the one or more printhead caps. Opening the pinch tubes releases negative pressure created by the vacuum pump. In response, ink is drawn from the one or more printheads into the one or more printhead caps.

Further moving the cam shaft lowers the cap carriage and enables the wiper blades to pass back across the nozzle face to clean the ink jet printhead nozzles. The vacuum pump is then deenergized, while the cap carriage remains in position so that the one or more printhead caps cap the one or more printheads awaiting the printing mode of the printer. Thus, the one or more printheads remain capped at the maintenance station until the printer is into the printing mode.

These and other features and advantages of this invention are described in or are apparent from the detailed description of various exemplary embodiments of the systems and methods according to this invention.

BRIEF DESCRIPTION OF THE DRAWINGS

Various exemplary embodiments of this invention will be described in detail with reference to the following figures, wherein like numerals represent like elements, and wherein.

DETAILED DESCRIPTION OF EXEMPLARY EMBODIMENTS

Figure 1:
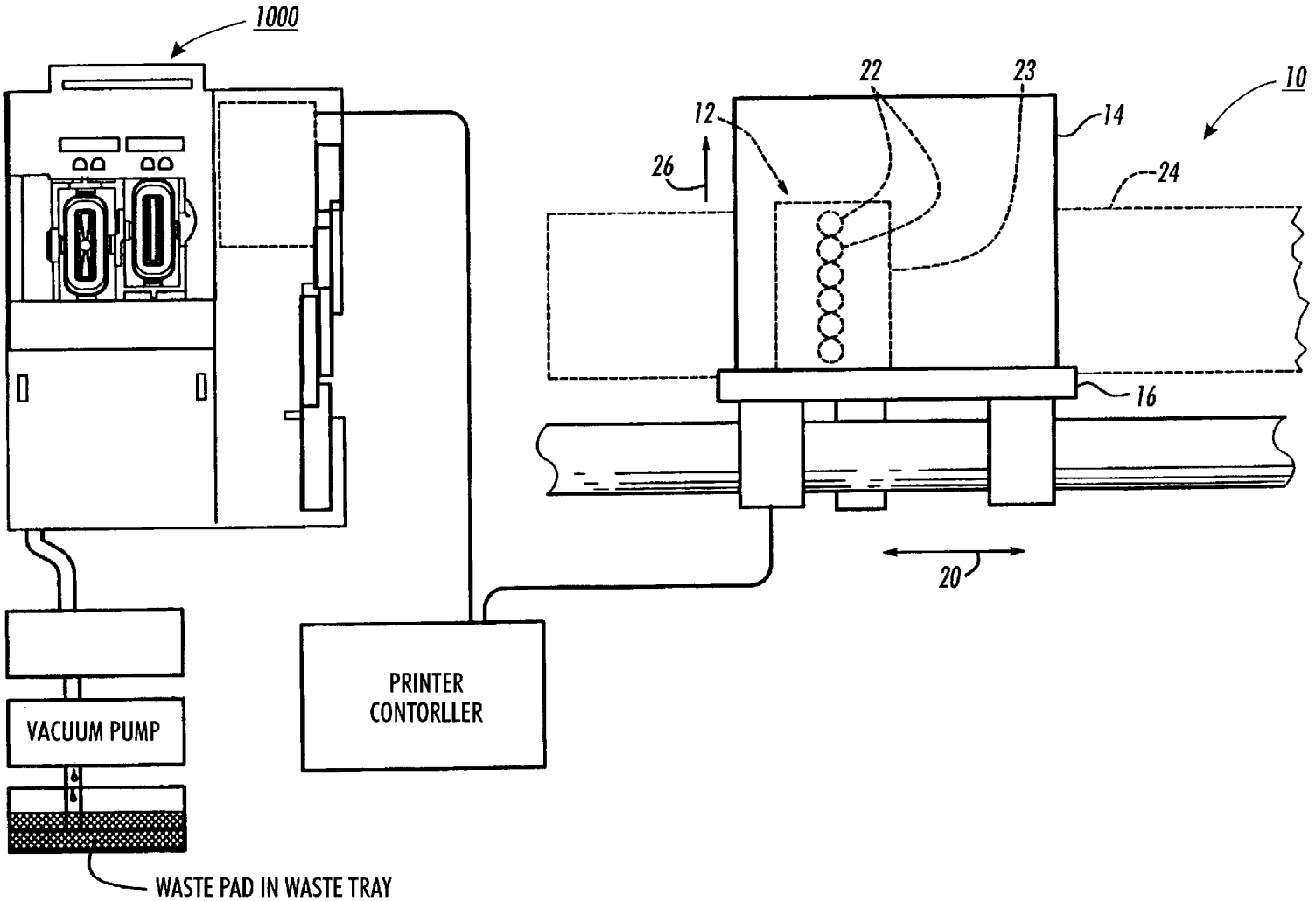
FIG. 1 is a schematic front elevation view of an ink jet printer and a maintenance station according to this invention.

FIG. 1 shows a printer 10, including one or more printheads 12, shown in dashed line, fixed to an ink supply cartridge 14. The ink supply cartridge 14 is removably mounted on a carriage 16. The carriage 16 is translatable back and forth on one or more guide rails 18 as indicated by the arrow 20, so that the one or more printheads 12 and the ink supply cartridge 14 move concurrently with the carriage 16. Each of the one or more printheads 12 contains a plurality of ink channels which terminate in nozzles 22 in a nozzle face 23 (both shown in dashed line). The ink channels carry ink from the ink supply cartridge 14 to the printhead nozzles 22.

When the printer 10 is in a printing mode, the carriage 16 translates or reciprocates back and forth across and parallel to a printing zone 24 (shown in dashed line). Ink droplets are selectively ejected on demand from the printhead nozzles 22 onto a recording medium, such as paper, positioned in the printing zone, to print information on the recording medium one swath or portion at a time. During each pass or translation in one direction of the carriage 16, the recording medium is stationary. At the end of each pass, the recording medium is stepped in the direction of arrow 26 for the distance or the height of one printed swath. U.S. Pat. No. 4,571,599 and U.S. Pat. No. Re. 32,572, each incorporated herein by reference in its entirety, provide a more detailed explanation of the printhead and the printing operation.

When the printer 10 is no longer in a printing mode, the carriage 16 travels to a maintenance station 1000 spaced from the printing zone 24. With the one or more printheads 12 positioned at the maintenance station 1000, various maintenance functions can be performed on the one or more printheads 12.

Figure 2:
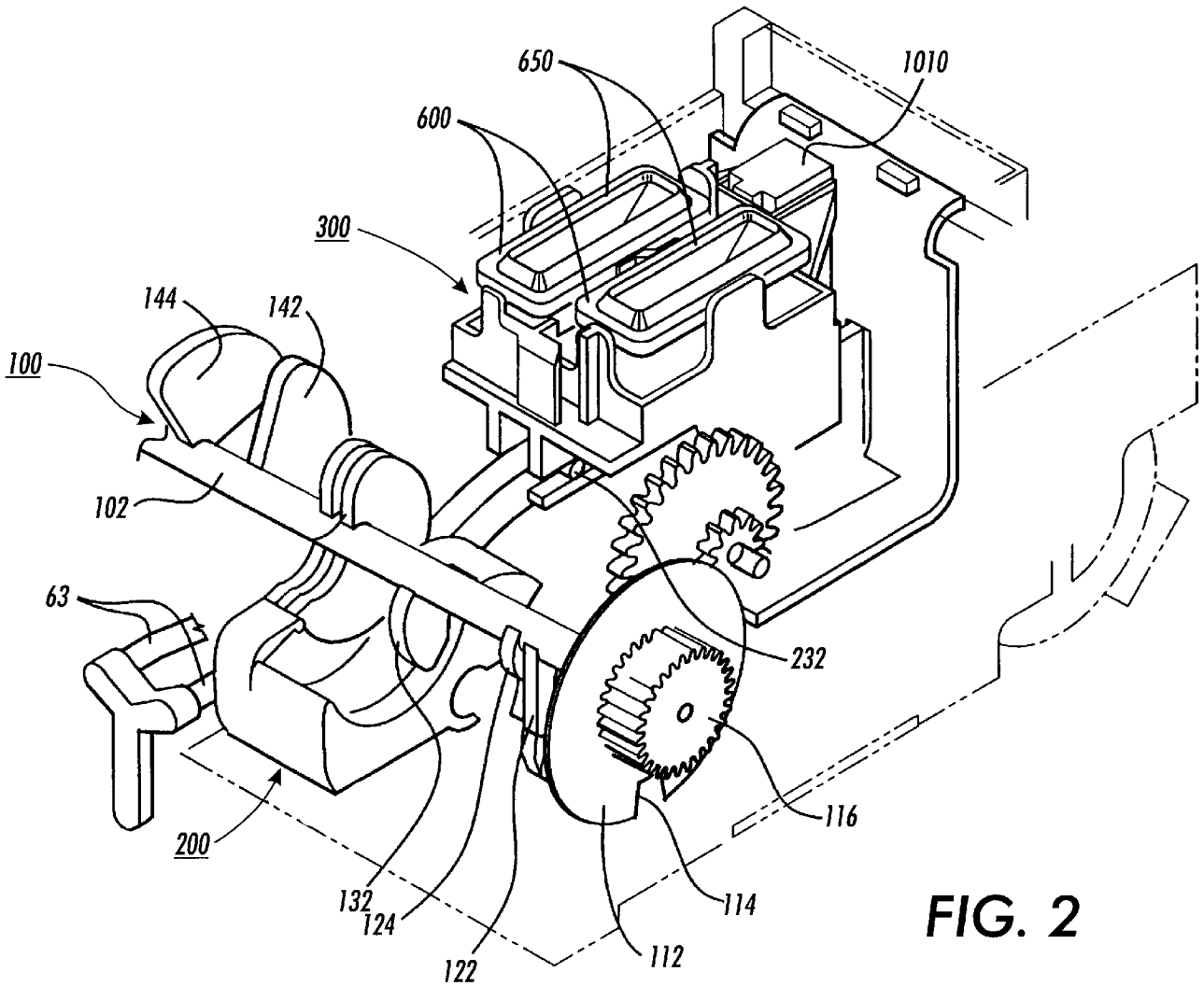
FIG. 2 is a top perspective view of the interior of a maintenance station of FIG. 1 according to this invention.

FIG. 2 is a top perspective view of the maintenance station 1000. As shown in FIG. 2, the maintenance station 1000 includes a cam shaft 100, a cam-actuated lever capping arm 200, and a cap carriage 300 mounted on a guide shaft 1010. In particular, as shown in FIG. 2, and more clearly seen in FIG. 3, the cam shaft 100 includes a driving and control portion 110, a wiper blade drive portion 120, a cam-actuated lever capping arm drive portion 130 and a pinch tube actuating portion 140.

Figure 3:
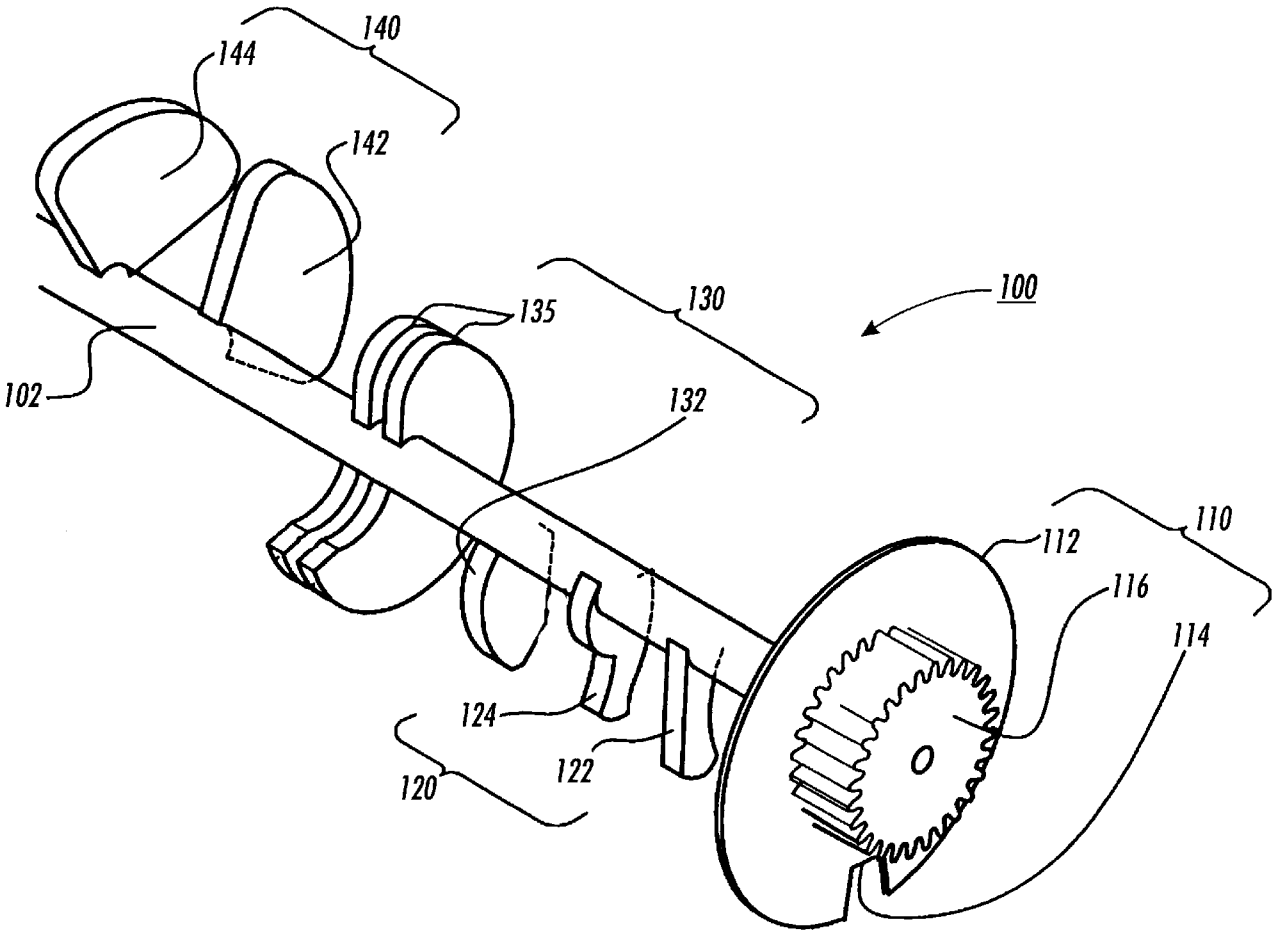
FIG. 3 is a perspective view of the cam shaft of FIG. 2.

In various exemplary embodiments, as shown in FIGS. 2 and 3, the driving and control portion 110 includes a sensor wheel 112, an optical window 114 formed in the sensor wheel 112, and a main drive gear 116. In operation, a drive gear train (not shown), comprising a drive motor connected to one or more drive gears, engages the main drive gear 116 to drive the cam shaft 100 in counterclockwise and then clockwise directions to actuate the various maintenance functions enabled by the maintenance station 1000. This is described in greater detail in copending U.S. patent application Ser. No. 09/594,694 filed herewith and incorporated herein by reference in its entirety.

In each of an extreme clockwise position of the cam shaft 100 and the extreme counterclockwise position of the cam shaft 100, the optical window 114 is aligned with an optical relay (not shown). Thus, after the drive gear train drives the main drive gear 116 to rotate the cam shaft 100 to the extreme clockwise or counterclockwise position, the optical window 114 formed in the sensor wheel 112 is aligned with the optical relay. In various exemplary embodiments, the optical relay includes a photo-emitter positioned on one side of the sensor wheel 112 and a photo-detector positioned on the other side of the sensor wheel 112. When the optical window 114 is not aligned with the optical relay, the optical relay is in an opened circuit condition.

At the start of a maintenance operation, the sensor wheel 112 is in the extreme clockwise position and the optical window 114 is aligned with the optical relay to close the circuit through the optical relay. As a result, when the one or more printheads 12 are aligned with the maintenance station 1000 and the main drive gear 116 is initially driven in the counterclockwise direction, the optical window 114 is no longer aligned with the optical relay and the optical relay is placed into an open circuit condition. Then, when the sensor wheel 112 reaches its extreme counterclockwise position, the window 114 is again aligned with the optical relay. As a result, the optical relay is placed in the closed circuit condition.

The open and closed circuit conditions of the optical relay are sensed by a controller (not shown). In response, the controller stops the gear train engaged with the main drive gear 116 from turning the cam shaft 100 for a predetermined time. In particular, this predetermined time depends on the priming mode currently selected for the maintenance station 1000.

Once the predetermined time has elapsed, the controller starts the gear train to drive the main drive gear 116, and thus the cam shaft 100, in the clockwise direction. The cam shaft 100 continues rotating in the clockwise direction until the optical window 114 in the sensor wheel 112 is again aligned with the optical relay to again put the optical relay in a closed circuit condition. When the controller again senses the closed circuit condition of the optical relay, the controller again stops the gear train from driving the main drive gear 116, and thus the cam shaft 100, in the clockwise direction.

In particular, in various exemplary embodiments, when the cam shaft 100 first begins rotating in the counterclockwise direction, the wiper blade portion 120 drives a wiper blade platform (not shown) from a first position to a second position to wipe the nozzle faces 23 of the one or more printheads 12. Then, when the cam shaft 100 is driven in the clockwise direction, the wiper blade drive portion 120 of the cam shaft 100 lastly drives the wiper blade platform from the second position back to the first position to again wipe the nozzle face 23 of the one or more printheads 12 before the printhead 14 is moved from the maintenance station 1000 to the printing zone 24. The wiper blade platform, a wiper blade drive mechanism positioned between the cam shaft 100 and the wiper blade platform, and the operation of the wiper blade drive portion 120 is described in greater detail in the incorporated Ser. No. 09/594,694.

In various exemplary embodiments, after the wiper blade drive portion 120 moves the wiper blade platform from the first position to the second position, the cam shaft 100 rotates further in the counterclockwise direction. As a result, the cam-actuated lever capping arm drive portion 130 interacts with a cam-actuated lever arm 200 to move a cap carriage 300 from a disengaged position to an engaged position. In the engaged position, one or more printhead caps 600 carried by the cap carriage 300 engage the one or more printheads 12 as the cam shaft 100 continues to rotate in the counterclockwise direction. Similarly, when the cam shaft 100 is driven in the clockwise direction, the cam-actuated lever capping arm drive portion 130 interacts with the cam-actuated lever arm 200 to move the capping carriage 300 from the engaged position to the disengaged position, before the wiper blade drive portion 120 moves the wiper blade platform from the second position back to the first position. This is described in greater detail below. The structure and operation of the printhead caps 600 are described in greater detail in copending U.S. patent application Ser. No. 09/594,682 filed herewith and incorporated herein by reference in its entirety.

Likewise, after the cam-actuated lever capping arm drive portion 130 moves the capping station 300 from the disengaged position to the engaged position, the cam shaft 100 rotates further in the counterclockwise direction. As a result, the pinch tube actuating portion 140 actuates one or more pinch tubes 63 to apply a negative pressure to the one or more printheads cap 600 mounted on the cap carriage 300. The structure and operation of the pinch tubes and pinch mechanism is described in greater detail in copending U.S. patent application Ser. No. 09/594,680 filed herewith and incorporated herein by reference in its entirety.

In the exemplary embodiments shown in FIGS. 2 and 3, the cap carriage 300 carries two printhead caps 600, each having a separate pinch tube 63. Accordingly, the pinch tube actuation portion 140 includes a first pinch tube actuating cam 142 and a second pinch tube actuation cam 144. The first pinch tube actuating cam 142 actuates a first pinch mechanism to pinch a first pinch tube 63 connected to the first one of the two printhead caps 600. Similarly, the second pinch tube actuating cam 144 actuates a second pinch mechanism to pinch a second pinch tube 63 connected to the second one of the two printhead caps 600.

The cam shaft 100 then continues to rotate in the counterclockwise direction until the cam shaft 100 reaches the extreme counterclockwise position. The controller, based on the signal from the optical relay generated when the optical window 114 is aligned with the optical relay, maintains the cam shaft 100 in the extreme counterclockwise position for one of the predetermined times.

Then, after the predetermined time has elapsed, the controller engages the drive motor of the drive gear train to rotate the cam shaft 100 in the clockwise direction. When the cam shaft 100 is rotated in the clockwise direction, the pinch tube actuation portion 140 again interacts with the one or more pinch tubes before the cap carriage 300 is moved from the engaged position to the disengaged position by the cam-actuated lever capping arm drive portion 130, which occurs before the wiper blade drive portion 120 moves the wiper blade platform from the second position to the first position.

As shown in FIGS. 2 and 3, the various elements of the cam shaft drive portion 110, the wiper blade drive portion 122, the cam-actuated lever capping arm drive portion 130 and the pinch tube actuation portion 140 are mounted on a shaft 102 of the cam shaft 100. As shown in FIGS. 2 and 3, in various exemplary embodiments, the wiper blade drive portion 120 includes a forward wiper driving cam 122 that is used to drive the wiper blade platform from the first position to the second position, and a reverse wiper blade driving cam 124 that is used to drive the wiper blade platform from the second position back to the first position.

In the exemplary embodiments shown in FIGS. 2 and 3, the cam-actuated lever capping arm drive portion 130 includes a hold-down cam 132 and one or more capping cams 134. The structure and operation of the am-actuated lever capping arm drive portion 130 and the am-actuated lever capping arm 200 are described in greater detail in copending U.S. patent application Ser. No. 09/721,954 filed herewith and incorporated herein by reference in its entirety.

As outlined above, the cap carriage 300 includes one or more overhead caps 600. As outlined above, when the cap carriage is moved from the disengaged position to the engaged position by the cam-actuated capping lever arm 200, the printhead cap 600 engage the nozzle faces 23 of one or more printheads 12. In particular, each of the printhead caps 600 needs to securely engage the nozzle face 23 of one of the one or more printheads 12 to ensure the negative pressure applied through the corresponding one or more pinched tubes 63 is able to withdraw ink from the ink channels of the corresponding printhead 12.

That is, if the printhead cap 600 does not securely engage the nozzle face 23 of the corresponding printhead 12, the negative pressure applied through the one or more pinched tube 63 merely draws atmospheric into the interior of the printhead cap 600 rather than withdrawing ink from the ink channels of the corresponding printhead 12. Accordingly, in various exemplary embodiments of the printhead cap 600, the printhead caps 600 are provided with a compressible gasket 650. However, even with the compressible gasket 650, the printhead caps 650 cannot securely engage the printhead nozzle faces 23 if the printhead cap 600 are not substantially parallel to, and biased against the nozzle faces 23.

Figure 4:
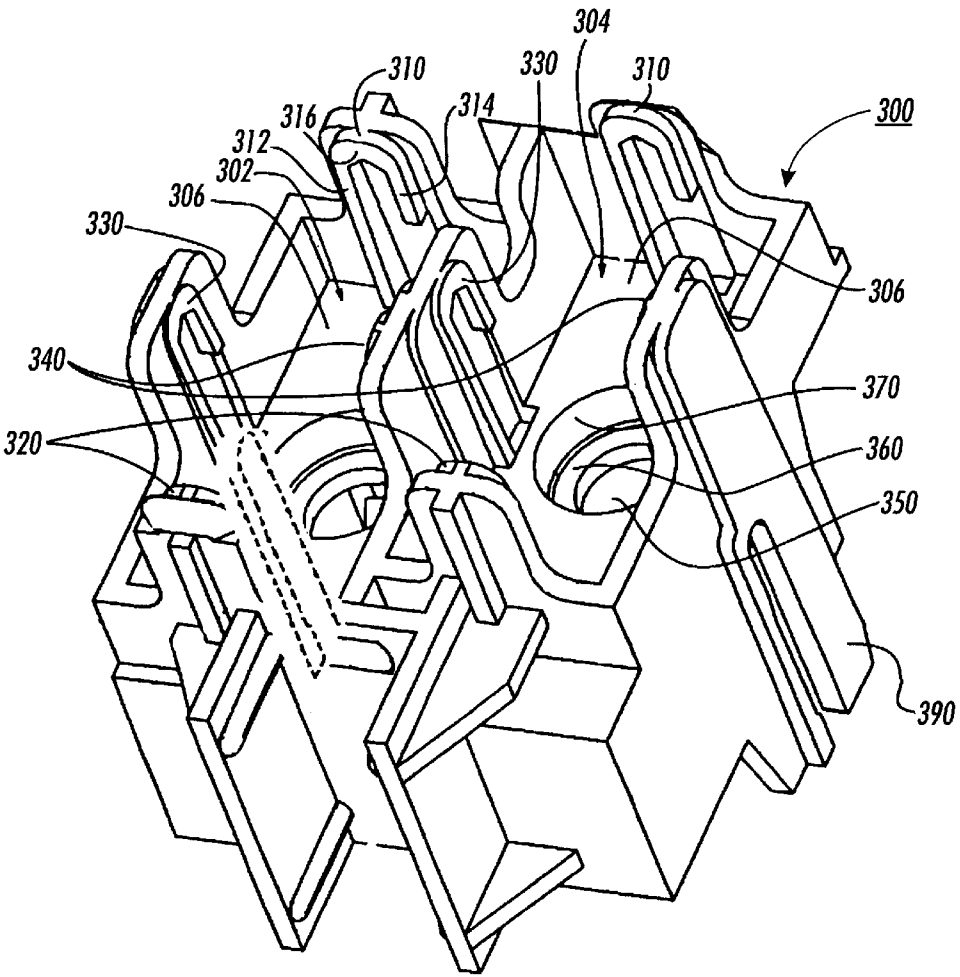
FIG. 4 is a top perspective view of the cap carriage showing one exemplary embodiment or the cap gimbaling mechanism according to this invention.
Figure 5:
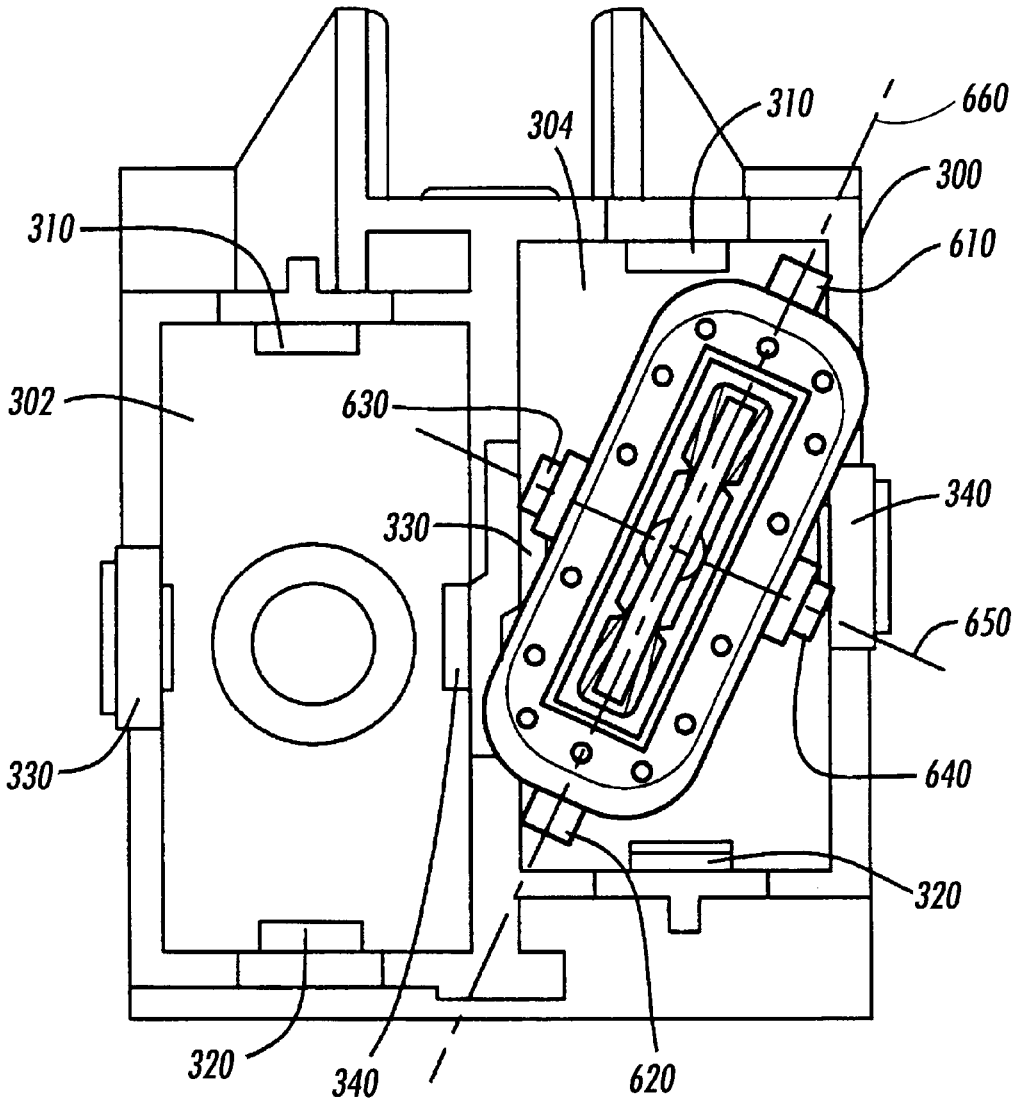
FIG. 5 is a top plan view showing one exemplary embodiment of a printhead cap usable with the cap gimbaling mechanism shown in FIG. 4.

Accordingly, as shown in FIGS. 4–7, the printhead caps 600 are not mounted on the cap carriage 300 in a fixed position. Rather, as shown in FIGS. 4–8, the printhead caps 600 are mounted using a cap gimbal structure. As shown in FIG. 4, the cap carriage portion of the cap gimbal structure includes four hook-shaped and grooved channels 310, 320, 330 and 340 formed in each of a first cap mounting portion 302 and a second cap mounting portion 304 of the cap carriage 300. As shown in FIG. 5, each of the printhead caps 600 includes a number of gimbal pins 610, 620, 630 and 640 formed on the periphery of the printhead cap 600 that form the cap gimbal portion of the gimbal structure according to this invention.

In particular, referring to FIGS. 4 and 5, each of the gimbal pins 610–640 fit into a corresponding one of the hook-shaped and grooved channels 310–340, respectively, formed in one of the cap carrying portions 302 and 304 of the cap carriage 300. In the various exemplary embodiments, the gimbal pins 610–640 slide along the long axes of the hook-shaped and grooved channels 310–340. In particular, each of the gimbal pins 610–640 can individually move within its corresponding hook-shaped and grooved channel 310–340.

As a result, the printhead cap 600, using this gimbal structure according to this invention, has at least two degrees of rotational freedom. In particular, each of the printhead cap 600 can rotate approximately 25–30 degrees about each of two orthogonal axes 650 and 660 defined by the pairs of gimbal pins 630 and 640, and 610 and 620, respectively. Additionally, the printhead cap 600 can rotate approximately 6 degrees in either the clockwise or counterclockwise direction, perpendicular to the plane created by the orthogonal axes 650 and 660. As a result, each of the printhead cap 600 can rotate about the two orthogonal axes 650 and 660 when engaging the nozzle surface 23 of a corresponding printhead 12 to ensure that, as long as the nozzle face 23 is within 25–30 degrees of parallel relative to the cap carriage 300, the printhead cap 600 will be able to rotate into a parallel relationship with that nozzle face 23. Accordingly, when that printhead cap 600 is biased against the corresponding nozzle face 23, the printhead cap 600 will securely engage the nozzle face 23 so that the negative pressure applied through the pinch tube 63 is able to withdraw ink from the ink channels of that printhead 12, rather than merely drawing ambient air from the region surrounding the nozzle face 23 of that printhead 12.

As can be most easily seen with respect to the hook-shaped and grooved channels 310 in FIG. 4, the hook-shaped and grooved channels 310–340 each have a first sidewall 312 that extends fully from a base 306 to atop portion 316. In contrast, a second sidewall 314 of each hook-shaped and grooved channel 310–340 extends only partway down from the top wall 316 towards the base 306. Thus, as shown in FIG. 5, by slightly twisting the printhead cap around a vertical axis in a first direction, the printhead cap can be easily removed from the hook-shaped and grooved channels 310–340, while, by rotating the printhead cap 600 in the opposite direction, the printhead cap 600 can be easily installed into the hook-shaped and grooved channels 310–340. In particular, the sidewalls 312 and 314 and the top wall 316 form a generally "shepherd's-hook" shape that engages the gimbal pins and allows the printhead cap 600 to align itself within the recess of the shepherd's hook.

Figure 6:
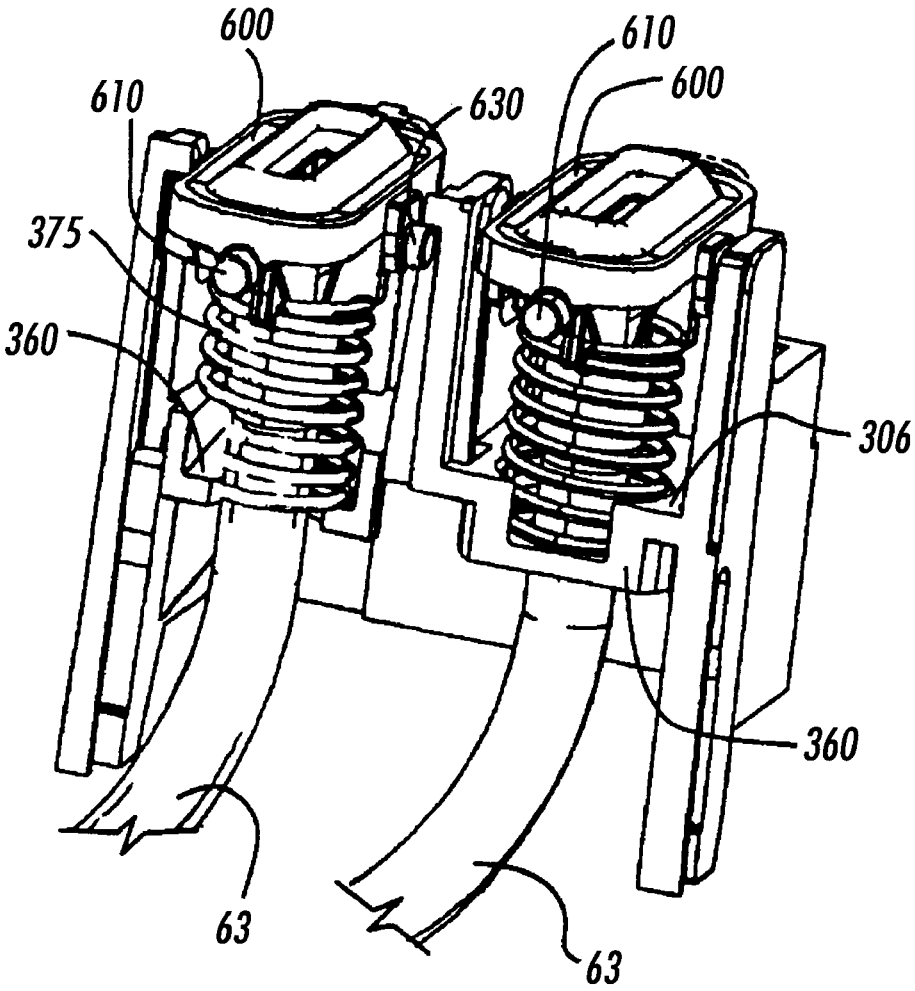
FIG. 6 is a cut-away perspective view of the cap carriage of FIG. 2, showing two printhead caps supported within the cap gimbaling mechanism shown in FIG. 4.

Additionally, as shown in FIG. 4, each cap carrying portion 302 and 304 has formed in its base surface 306 a circular depression 350 having a recessed circular support shelf 360. The recessed circular support shelf 360 is designed to accept a support spring 375, as shown in FIG. 6, that biases the printhead cap 600 away from the base of surface 306 so that the gimbal pins 610–640 are securely held in the recess formed between the sidewalls 312 and 314 and under the top wall 316. The support spring 375 also provides the bias force that securely engages the printhead cap 600 against the nozzle face 23 of the corresponding printhead 12.

The angled surface 370 extending between the base surface 306 and the recessed circular support shelf 360 ensures that the support spring 375 remains generally centered in the circular depression 350.

Thus, it should be appreciated that, the hook-shaped and grooved channels 310–340, in combination with the gimbal pins 610–640, and the support spring 375 positioned in the circular depression 350 and supported by the recessed circular support shelf 360 creates a gimbal mechanism that allows the printhead cap 600 to rotate about the rotational axis 650 and 660 with two degrees of freedom.

FIG. 6 shows the printhead cap 600 with the gimbal pin 610–640 installed in the hook-shaped and grooved channels 310–340 with the support springs 375 inserted into the circular depression 350 and supported by the recessed circular support shelf 360 at one end and supporting the printhead cap 600 at its other end.

Figure 7:
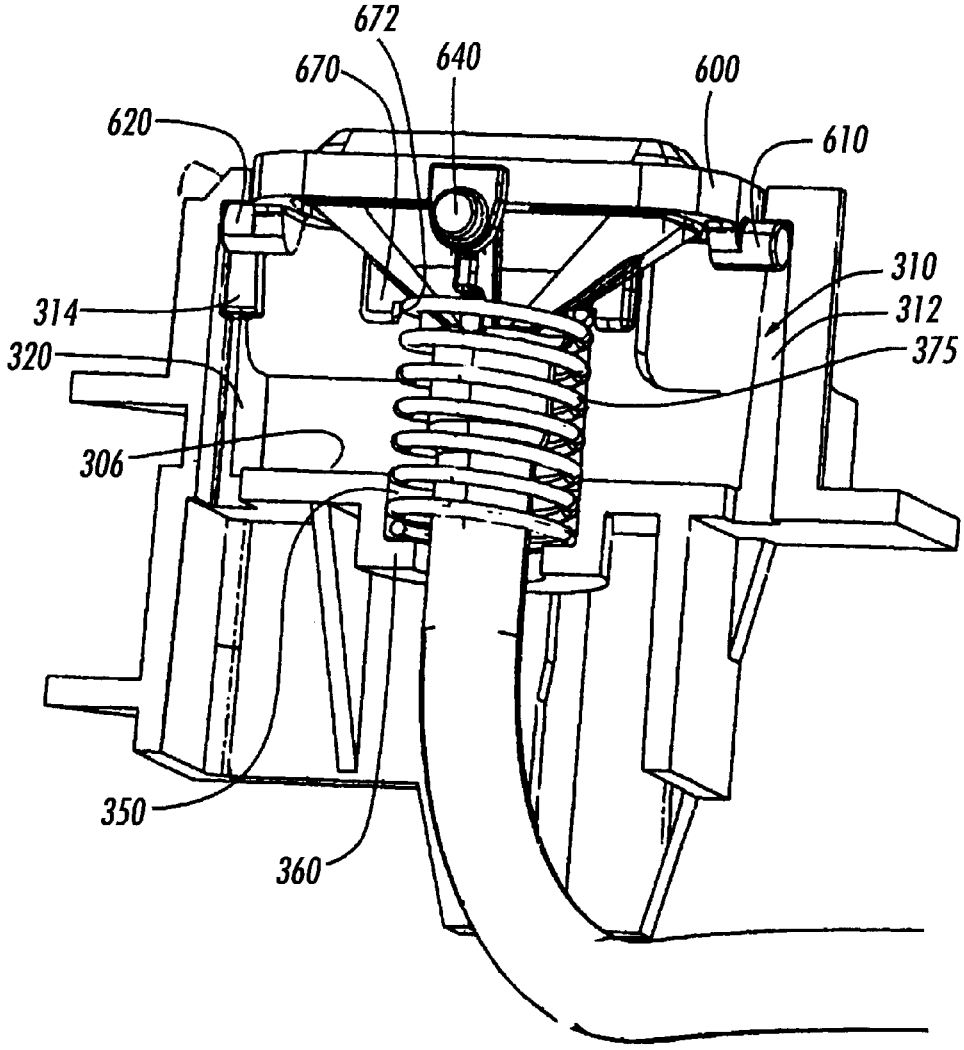
FIG. 7 is a perspective view of the cap carriage of FIG. 2, showing a cut-away quarter-section of the cap gimbaling mechanism of FIG. 4 and an individual printhead cap.

FIG. 7 shows the printhead cap 600 installed in the hook-shaped and grooved channels 310–340 in even greater detail. In particular, shown in FIG. 7, a number of spring support and positioning bosses 670 can be seen formed on a bottom portion of the printhead cap 600. As shown in FIG. 7, the gimbal pins 610–640 of the printhead cap 600 are installed in the hook-shaped and grooved channels 310–340 with the support spring 375 positioned in the circular depression 350, the support spring 370 fits into notches 672 formed in the bosses 670 to securely position the support spring 375 relative to the printhead cap 600.

Figure 8:
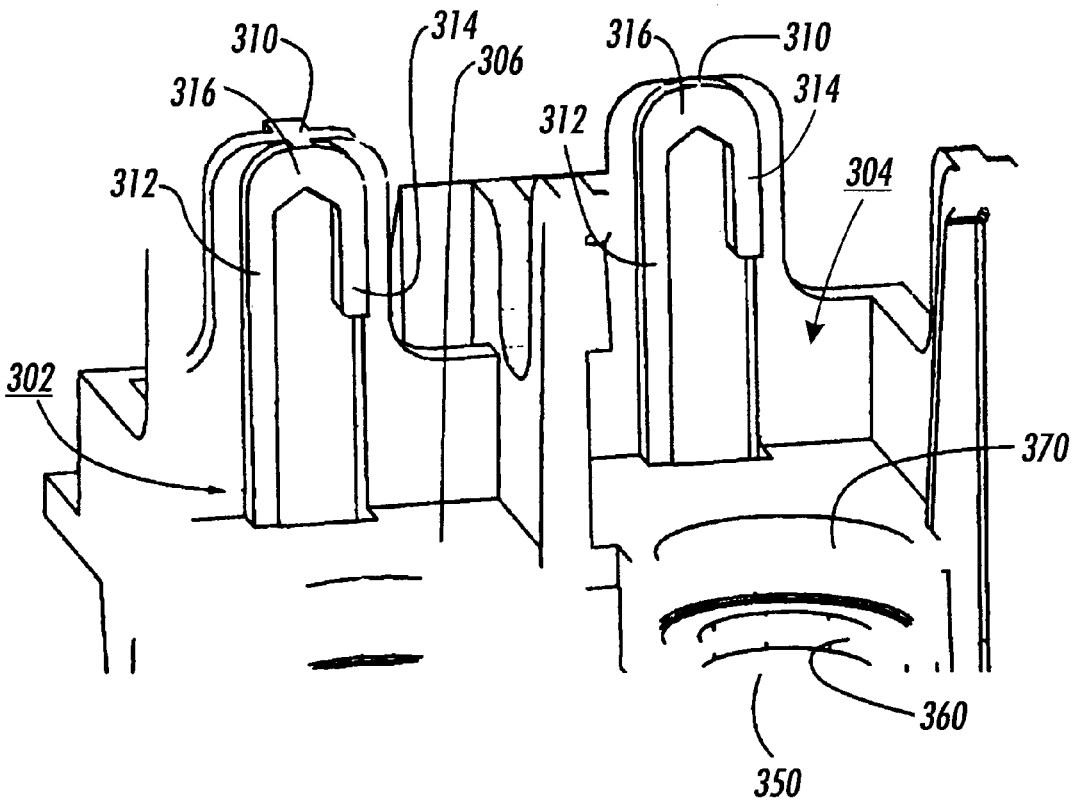
FIG. 8 is a perspective view of the cap carriage of FIG. 2 showing, a portion of in greater detail the cap gimbaling mechanism according to this invention.

Finally, FIG. 8 shows the hook-shaped and grooved channels 310 formed in the cap carrying portions 302 and 304 of the cap carriage 300 in greater detail, more clearly showing the "shepherd's hook" shape of this exemplary embodiment of the hook-shaped and grooved channels 310–340.

While this invention has been described with specific embodiments thereof, it is evident that many alternatives, modifications, and variations will be apparent to those skilled in the art. Accordingly, the preferred embodiments of the invention as set forth herein are intended to be illustrative, not limiting. Various changes may be made without departing from the spirit and scope of the invention.

What is claimed is:

1. A gimbaling system usable with a maintenance station of an ink jet printer comprising:

a plurality of hook shaped and grooved gimbaling channels each having a first sidewall that extends fully from a base of the gimbaling channel to a top portion of the gimbaling channel and a second sidewall that extends partway from the top portion of the gimbaling channel to the base of the gimbaling channel;

a bias force applying member; and a printhead maintenance cap having a plurality of gimbal engaging protrusions;

wherein:

the gimbal engaging protrusions engage the plurality of gimbaling channels; and the bias force applying member applies a bias force to gimbal the printhead maintenance cap such that the printhead maintenance cap can move within the plurality of gimbaling channels to gimbal about at least two rotational axes and translate along one translational axis.

2. The gimbaling system of claim 1, wherein:

each gimbaling channel comprises at least one wall defining a recessed gap; and rotating the printhead maintenance cap forces the gimbal engaging protrusions into the recessed gaps of the gimbaling channel.

3. The gimbaling system of claim 2, wherein the printhead maintenance cap can rotate approximately 25 degrees about each of two of the at least two rotational axes.

4. The gimbaling system of claim 2, wherein, for each gimbaling channel, the at least one wall has a plurality of curved closed portions.

5. The gimbaling system of claim 4, wherein, for each gimbaling channel, the plurality of curved closed portions form a hook-shaped recessed gap.

6. The gimbaling system of claim 4, wherein the plurality of gimbaling channels align the gimbal engaging protrusions to provide at least three degrees of freedom of movement.

7. The gimbaling system of claim 6, wherein the gimbaling channels prevent the undesirable disengagement of the gimbal engaging protrusions of the printhead maintenance cap from the gimbaling channels.

8. An ink jet printer, comprising:

an ink jet maintenance station having the gimbaling system of claim 1.

* * * * *